United States Patent [19]

Maloney

[11] Patent Number: 4,653,805

[45] Date of Patent: Mar. 31, 1987

[54] FOLDABLE HIGH CHAIR

[75] Inventor: Kevin Maloney, Columbus, Ind.

[73] Assignee: Cosco, Inc., Columbia, Ind.

[21] Appl. No.: 747,855

[22] Filed: Jun. 24, 1985

Related U.S. Application Data

[62] Division of Ser. No. 581,977, Feb. 21, 1984, Pat. No. 4,603,902.

[51] Int. Cl.[4] ..... A47C 3/00

[52] U.S. Cl. ..... 297/284; 297/464

[58] Field of Search ..... 297/284, 460, 464, 486

[56] References Cited

U.S. PATENT DOCUMENTS

| | | | |
|---|---|---|---|
| 2,619,157 | 11/1952 | Guyton et al. | 297/284 |
| 2,822,034 | 2/1958 | Dixon | 297/464 |
| 3,608,960 | 9/1971 | Sherman | 297/284 |
| 3,773,382 | 11/1973 | Coursault et al. | 297/284 |
| 4,321,044 | 3/1982 | Kron | 297/284 |
| 4,370,000 | 1/1983 | Kazaoka et al. | 297/284 |
| 4,500,136 | 2/1985 | Murphy et al. | 297/284 |

*Primary Examiner*—Francis K. Zugel

*Attorney, Agent, or Firm*—Barnes & Thornburg

[57] ABSTRACT

A foldable child's high chair has a use position wherein an occupant can occupy the chair and a folded position wherein the chair can be folded for storage. The chair includes a seat having a base portion and a back support portion. The back support portion includes a stationary section and a movable section which is movable to position the child. A retaining latch is provided for retaining the movable section in at least two different selected positions relative to the stationary section. A frame is provided for supporting the seat and includes a front leg and a rear leg. A first pivot is provided for pivotally coupling the base portion to the front leg, and a second pivot is provided for pivotally coupling the base portion to the rear leg. A third pivot is provided for pivotally coupling the back support to the rear leg. A rigid link member and a pair of pivots are provided for coupling the back support portion to the base portion. The frame, seat, link member, and pivots are cooperable so that when the chair is moved between its use position and its folded position, the base portion pivots in one direction and the back support portion pivots in an opposite direction.

4 Claims, 10 Drawing Figures

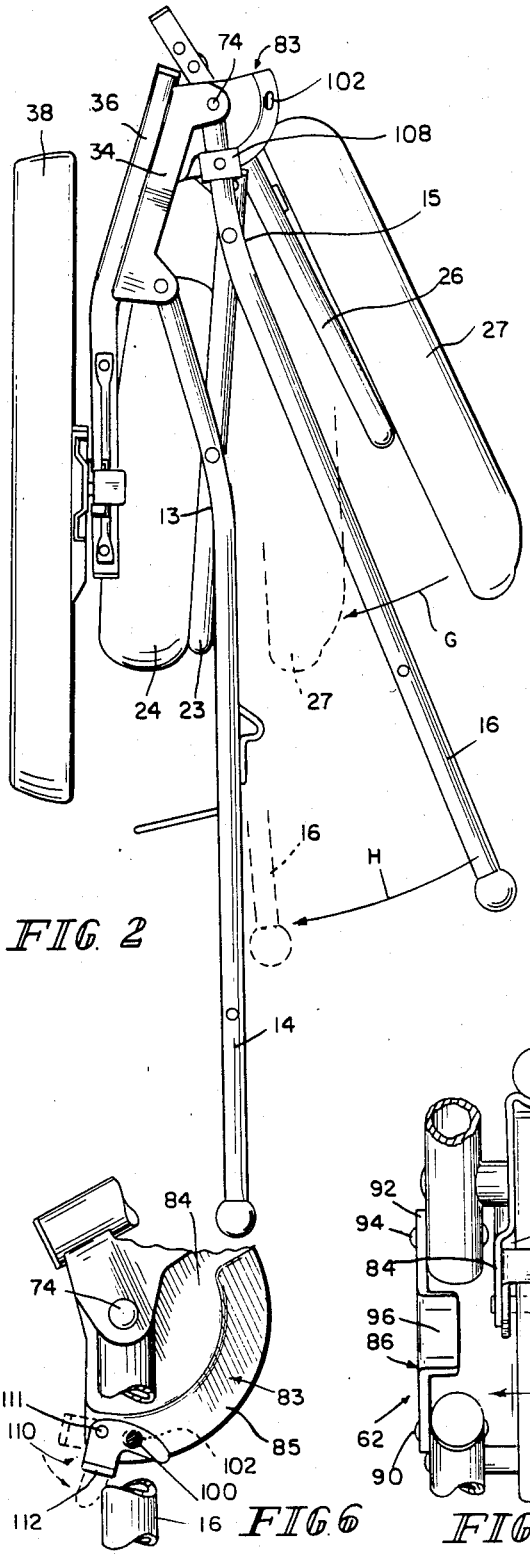
FIG. 2
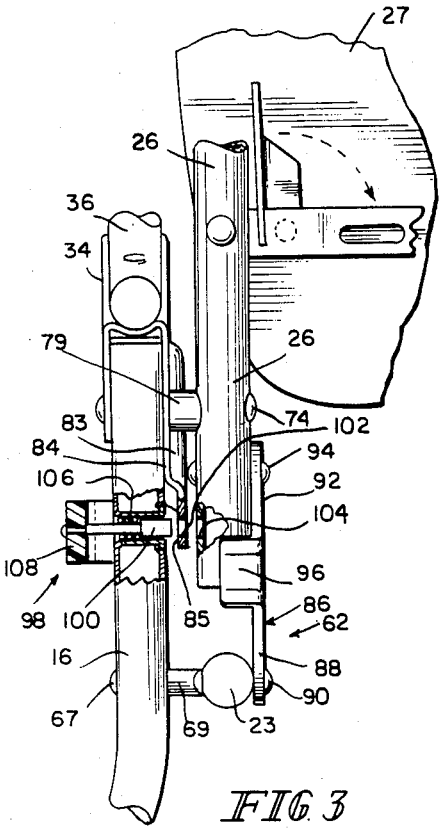
FIG. 3
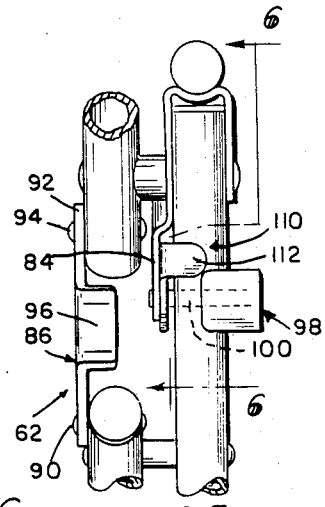
FIG. 5
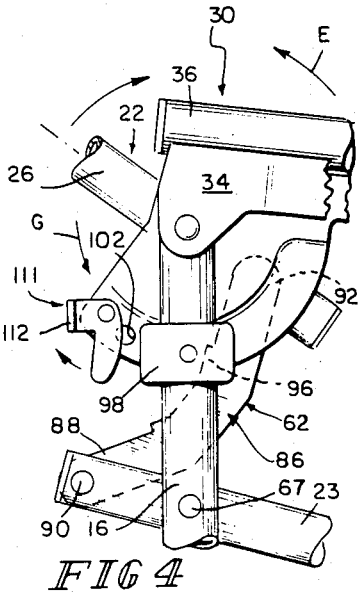
FIG. 4
FIG. 6

FOLDABLE HIGH CHAIR

This is a division of application Ser. No. 581,977 filed Feb. 21, 1984, now U.S. Pat. No. 4,603,902.

This invention relates to chairs, and more particularly to foldable juvenile chairs.

Foldable chairs are known. Heretofore, folding chairs have generally included a seat having a back support portion and a base portion, a pair of front leg members and a pair of back leg members. The front legs are joined to the back legs at a pivot to form a cross or X-frame structure. Various X-frame folding chair structures are shown in McRae U.S. Pat. No. 3,147,036 and Duer U.S. Pat. No. 3,220,764.

Other folding mechanisms for chairs are shown in Lisi U.S. Pat. No. 2,789,623; Panicci U.S. Pat. No. 3,058,773; Goldsholl et al U.S. Pat. No. 3,113,802; Spinola U.S. Pat. No. 3,542,419 and Lay et. al. U.S. Pat. No. 3,715,142.

The juvenile chair according to the present invention has a structure which is cooperable during folding to enable the base portion and back support portions of the seat to pivot in opposite directions when the chair is folded from its use position to its storage position.

One object of the instant invention is to provide a chair which pivots in the above described manner to provide a stable seat for a child, when the chair is in its use position, and a compact structure for storage when the chair is in its folded position.

The base portion and back support portions of conventional juvenile high chairs usually consist of unisectional, nonadjustable cushions. Examples of such cushions are shown in the patents discussed above. The unisectional cushions are usually made generally planar and wide enough to accommodate larger, older high chair users. The width and planarity of these unisectional cushions can present an impediment to the use of the chairs by younger infants. By making the cushions wide enough to accommodate larger children, the cushions are often much wider than the children when they are first beginning to use the chair as young babies and infants. Younger babies and infants often are not either developed or coordinated sufficiently to sit up straight in the seats. Since the unisectional cushion provides no lateral support for the children, the children often tilt laterally, assuming a slumped position in the seats. Notwithstanding the foregoing problem, it may not be desirable to use a one-piece cushion which is contoured to fit the backs of the youngest high chair users. Since children tend to grow at a rapid rate, a chair having a cushion which is contoured to fit very young babies would probably be uncomfortable to older children. Thus, the effective length of use of a chair having such a fixed, contoured back would be unacceptably short.

It is therefore also an object of the instant invention to provide a chair having a seat with at least two back support sections, one of which is adjustable relative to the other to resist lateral movement of younger children and to provide a sufficiently wide, comfortable seating surface for older children.

In accordance with the instant invention, a small child's chair includes a seat having a base portion and a back support portion. The back support portion includes at least two sections, one movable with respect to the other to position the child. Retention means is provided for retaining the movable section with respect to a stationary section in a selected position.

Illustratively, the back support portion includes a generally rigid frame member and a cushion portion. The cushion portion includes a movable side section and a stationary central section. The cushion portion further includes cushioning material, and a generally rigid backing adjacent the frame member. The backing includes a central member corresponding in position to the central section of the cushion, and a side member corresponding in position to the side section of the cushion. A backing hinge means is provided for hingedly coupling the side member and central member of the backing.

Also in accordance with the instant invention, a foldable high chair is provided having a use position wherein an occupant can occupy the chair and a folded position wherein the chair can be folded for storage. The foldable high chair includes a seat having a base portion and a back portion. A frame including a front leg and a rear leg is provided for supporting the seat. A first pivot means is provided for pivotally coupling the base portion to the front leg. A second pivot means is provided for pivotally coupling the base portion to the rear leg. A third pivot means is provided for pivotally coupling the back support portion to the rear leg, and a link means is provided for coupling the back support portion to the base portion. A first link pivot means is provided for pivotally coupling one end of the link means to the base portion and a second link pivot means is provided for coupling the other end of the link means to the back portion. The frame, seat, pivot means, and link means are cooperable so that when the chair is moved between its use position and its folded position, the base portion pivots in one direction and the back portion pivots in the opposite direction.

Illustratively, the chair also includes an arm member which is coupled to the frame. A first arm pivot means is provided for pivotally coupling the arm to the front leg and a second arm pivot means is provided for pivotally coupling the arm to the rear leg.

Preferably, the link means includes a rigid link member having a first portion to which the first pivot means is journaled, a second portion to which the second link pivot is journaled, and a stop means for limiting relative movement of the base and back portions of the seat.

Various features and advantages of the present invention will become apparent in view of the following detailed description of one embodiment thereof, which description should be considered in conjunction with the accompanying drawings in which:

FIG. 2 is a side elevational view of the chair in a partially folded position, with the chair shown in its fully folded position in phantom;

FIG. 3 is a view taken along the lines 3—3 of FIG. 1 with portions broken away;

FIG. 4 is a side view of the pivot structure of the instant invention, taken from the side opposite to that shown in FIG. 2, showing the pivot structure in a partially folded position;

FIG. 5 is an end elevational view of the pivot structure shown in FIG. 4;

FIG. 6 is a sectional view taken along lines 6—6 of FIG. 5;

Figure 1:
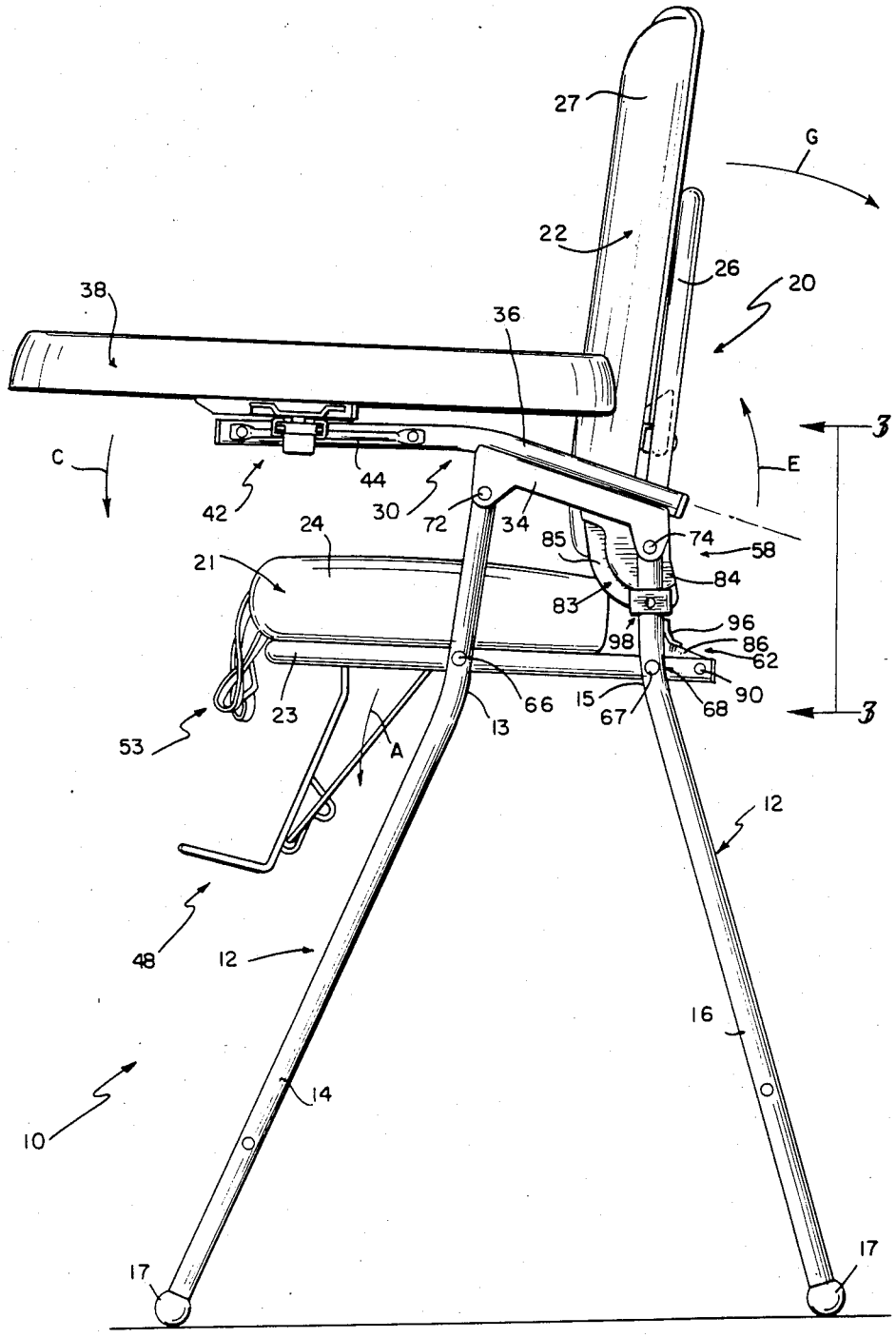
FIG. 1 is a side elevational view of the chair embodying the present invention in its use position.

A chair such as a foldable juvenile high chair 10 is shown in FIGS. 1–3. The chair 10 has a frame 12 which includes elongated tubular front legs 14 and elongated tubular rear legs 16. The front 14 and rear 16 legs are generally straight, with each having slight, obtuse bends 13,15 respectively near their upper ends. Plastic non-skid feet 17 are placed at the lower ends of legs 14,16 to provide a secure gripping surface for the legs 14,16 and to prevent the ends of the legs 14,16 from scratching or otherwise marring the flooring upon which the chair is placed. A cross-bar member (not shown) can be placed between the front legs 14 to stationarily position the front legs 14 with respect to each other. Likewise, a cross-bar member (not shown) can be placed between the rear legs 16 to stationarily position the rear legs 16 with respect to each other.

The chair also includes a seat 20 having a base portion 21 and a back support portion 22. When the chair 10 is in its use position (shown in FIG. 1), the base portion 21 is disposed generally parallel to the ground, and provides a surface upon which an occupant of the chair can sit. The back support portion 22 is disposed generally perpendicular to the ground when the chair 10 is in its use position, and provides a back rest and back support for an occupant occupant of the chair 10. The base portion 21 includes a generally U-shaped tubular frame member 23 and a padded, base cushion member 24, which is stationarily attached to base portion frame member 23. Back support portion 22 includes a tubular, inverted U-shaped back support frame member 26 and a back support cushion 27, a part of which is stationarily attached to back support frame member 26.

A pair of arms 30 extend generally parallel to the base frame member 23. One arm 30 is disposed on either side of seat 20. Arm 30 includes an inverted, elongated U-shaped channel member 34 which is coupled to the front 14 and rear 16 legs, and an arm member 36 which is generally elongated and tubular, and has an obtuse bend near its 36 middle. Arm member 36 is fixedly attached to channel 34 and is provided for supporting a tray 38. Tray 38 can be of conventional construction, and is preferably made out of a plastic material. Tray 38 includes a latch member 42 which is selectively positionable along rails 44 so that the tray 38 can be positioned properly for occupants of different sizes. Rails 44 preferably are fixedly attached to, and extend generally parallel to a portion of arm member 36.

A selectively positionable foot rest member 48 is mounted to the underside of base portion 21 to provide a rest for the occupant's feet. Preferably, the foot rest 48 is selectively positionable in a first position (shown in FIG. 1) wherein the foot rest 48 extends downwardly from base portion and a second position (not shown) wherein the foot rest 48 extends outwardly and forwardly of base portion 48. The foot rest 48 is positionable in its first position to provide a comfortable foot rest for older children, and is positionable in its second position to provide a comfortable foot rest for younger children. A harness strap 53 of conventional design is provided for harnessing and restraining a child in the chair 10.

A pivot means 58 and a link means 62 are provided so that the chair 10 can pivot from a use position; shown in FIG. 1, to a folded position shown in phantom in FIG. 2. In the chair's 10 use position, the back support portion 22 and base portion 21 are generally perpendicular, so that an occupant can occupy the chair, and the legs 14,16 are spaced by relatively large distance to provide a stable base for the chair 10. When the chair 10 is in its folded position, the back support portion 22 and base portion 21 are generally parallel and the legs 14,16 are spaced relatively closely, to provide a compact structure which will require a minimal amount of space for storage, and which is easily transportable. The frame 12, seat 20, pivot means 58, and link means 62 are cooperable so that when the chair 10 is moved between its use position and its folded position, the base portion 21 pivots in one direction, and the back support portion 22 pivots in the opposite direction.

Pivot means 58 includes a first base portion pivot means 66 for pivotally coupling the base portion frame member 23 to the front leg 14. Illustratively, first pivot 66 can comprise a rivet or a bolt and nut, with the shaft portion of the rivet or bolt defining the pivot axis. A spacer (not shown) may be placed on the shaft portion of the rivet or bolt to maintain the front leg 14 and base portion frame member 23 in a spaced relation. A second base portion pivot means 68 is shown in FIGS. 1 and 2–5, and is provided for pivotally coupling base portion frame member 23 to rear leg 16. Second base portion pivot means 68 is formed by a rivet 67 or nut and bolt arrangement similar to first base portion pivot means 66. The shaft portion of rivet 67 extends through aligned apertures in the leg 16 and base portion frame member 23. A spacer 69 may be placed between the leg 16 and frame member 23 to maintain the leg 16 and frame member 23 in the proper spacial relation.

A first arm pivot 72 is provided for pivotally coupling the channel 34 to the front leg 14. A third pivot means 74 serves both as a back support 22 pivot means for pivotally coupling the back support frame member 26 to rear leg 16, and as a second arm 30 pivot means for pivotally coupling the channel 34 to rear leg 16. As best shown in FIG. 3, third pivot 74 provides a collinear pivot axis for the back support pivot means and second arm pivot means. Since channel 34 is fixedly attached to arm member 36, first and second arm pivots 72, 74 serve to functionally connect the legs 14,16 to arm member 36. Since back support frame member 26 also pivots about pivot 74, the back support portion 22 is also functionally connected to the arms 30 and legs 14, 16. A spacer 79 is interposed between channel member 34 and back support frame member 26 to maintain the leg 16 and frame member 26 in the proper spacial relation. The spacer 79 also facilitates the folding of the chair by preventing the leg 16 and frame member 26 from rubbing against each other, or otherwise interfering with each other during the pivoting of the chair 10 between its use position and its storage position.

A runway or guide member 83 is formed as a part of channel 34. Channel 34 includes an extended portion 84 disposed between rear leg 16 and back support frame member 26 in the general vicinity of second arm pivot 74. Extended portion 84 includes a raised, arcuate surface 85 providing a runway or guide for a lock means 98 in a manner which will be explained later.

Link means 62 includes a planer, rigid, angled link member 86 having an end portion 88 and an end portion 92. A first link pivot means 90 pivotally couples end portion 88 of angled link member 86 to the base portion frame member 23, near the rearward end of frame member 23. The end portion 92 of link member 86 includes a second link pivot means 94. Second link pivot means 94 pivotally couples the link member 86 to the back support portion frame member 26. A stop means such as stop flange 96, is provided intermediate the end portions 88 and 92. Stop flange 96 is formed as a part of link member 86, and is angled generally perpendicularly to the link member 86 so as to engage the back support portion frame member 26 when the chair is in its use position (See FIG. 1).

The stop flange 96 is provided for limiting the relative pivotal movement of the chair 10 by providing a limit to the extent of rotation of back support portion frame member 26. Stop flange 96 is positioned to prevent back support frame member 26 from pivoting past the use position (shown in FIG. 1) when the chair 10 is being unfolded.

A lock button means 98 is provided for preventing the chair 10 from inadvertently folding out of its use position when an occupant is occupying the chair 10. Lock button means 98 includes a rod or pin 100 which extends through rear leg 16 and is extendable through an aperture 102 in runway 83 and into an aperture 104 in the back support frame member 26. Rod 100 and apertures 102,104 are positioned to be in alignment when the chair 10 is in its unfolded, use position. The button 98 also includes a spring 106 for urging rod 100 toward the apertures 102,104 and a pull button 108 for enabling a user to pull the rod 100 out of engagement with apertures 102,104. As best seen in FIG. 2, one of the apertures 102 is elongated so that at least one of the pins 100 will engage an aperture to prevent the chair from folding when the lock button means is not fully engaged. This is a safety feature to limit movement of the back support portion 22 when the lock means does not fully engage. As can be seen in FIGS. 3 and 4 when rod or pin 100 is disengaged from aperture 102 and the chair is folded; spring 106 urges pin 100 against the surface 85 of runway 83. Thus runway 83 serves to keep the pin 100 from engaging the frame or interfering with the operation of the chair during the folding and unfolding of the chair.

As shown in FIGS. 4–6, the lock button 98 also includes an interference finger 110 which is movably mounted to the raised arcuate surface 85 of runway 83 by pivot 111. The interference finger 110 is activated by gravity to prevent rod 100 from becoming inserted into apertures 102,104. Flange 112 is provided for the user to manipulate the finger 110 if desirable. When the chair 10 is being moved from its use position to its folded position, it is generally necessary for the user to pull outwardly on the pull buttons 108 of lock button 98 to disengage the rod 100 from the apertures 102,104. As can be appreciated, it might be difficult for a user to simultaneously pull the buttons 108 of both rear legs 16 while simultaneously moving either the seat 20 or frame 12 to fold the chair 10. The interference finger 110 moves over aperture 102 to prevent the rod 100 of at least one button means 98 from becoming inserted into apertures 102, 104, the user can free up one of his hands to grab either the frame 12 or seat 20 to pivot the seat 20 or frame 12 to commence the folding of the chair 10. It will be noted that the elongated aperture 102 is provided on the opposite side from the location of the interference finger 110.

To move the chair 10 from its use position (shown in FIG. 1) to its folded position (shown in FIG. 2), the user grips the button 108 (shown in FIG. 4) of the right rear leg 16 of the chair 10 to pull rod 100 out of engagement with apertures 102,104. Interference finger 110 moves by gravity into a position wherein it covers aperture 102 when rod 100 is moved out of aperture 102. Button 108 is then released, allowing rod 100 to rest against interference finger 110. The user then pulls outwardly on button 108 of left rear leg 16 to pull the left side rod 100 out of engagement with apertures 102,104. When rod 100 is out of engagement with apertures 102,104 the user can push rearwardly on the top of the back support portion 22 to begin the pivoting action of the pivot means 58 to move the chair into a folded position as shown in FIG. 2. During the folding, the base portion 21 of seat 20, tray 38, and arms 30 pivot in a first direction, and the back portion 22 of the seat and rear leg 16 pivot in a second direction, opposite the first direction.

Referring now to FIGS. 1 and 2, arrow A indicates the direction base portion 21 pivots. Arrow C indicates the direction that tray 38 pivots, and arrow E indicates the direction in which arm 30 pivots. When viewed from the left side of chair 10, as shown in FIGS. 1 and 2, arrows A, C, and E all are directed in a counterclockwise direction, indicating that the base portion 21, tray 38, and arm 30 pivot in a first, counterclockwise direction. Arrow G indicates the direction back support portion 22 pivots and arrow H (FIG. 2) indicates the direction rear leg 16 pivots. When viewed from the left side of the chair (as shown in FIGS. 1 and 2), arrows G and H indicate that back support portion 22 and leg 16, pivot in a second, clockwise direction. Referring now to FIG. 4, it will be noticed that arrow G indicates a counterclockwise rotation of back support portion 22 and arrow E indicates a clockwise pivoting of arm 30. This reversed condition is expected, since FIGS. 4–6 are views taken from the right side of the chair.

To move the chair from its folded position (shown in FIG. 2) to its use position (shown in FIG. 1) the process is reversed, with the leg 16, back support portion 22, tray 38, arm 30, and seat 20 being pivoted to a point wherein the stop means 96 of link member 86 is adjacent the back support portion frame member 26, and the rod 100 of lock means 98 is engaged into apertures 102,104. Because of the elongated aperture 102 at least one of the rods 100 will engage aperture 102 to limit backward movement of the back support portion 22 in case of a false locking condition. It will be appreciated that when the chair is moved from its folded position to its use position, the base portion 21, tray 38 and arm 30 will pivot in a clockwise direction, and the back support portion 22 and rear leg 16 will pivot in a counterclockwise direction (when viewing the chair 10 from its left side). During the unfolding operation rod 100 pushes the interference finger away from the corresponding aperture 104.

As best shown in FIGS. 7–10, the cushion portion 27 of back support portion 22 of seat 20 includes a stationary, central section 120 and a first side section 122 hingedly mounted to a first side of central section 120, and a second side section 124 hingedly mounted to a second side of central section 120. The first side section 122 is movable between a first position (shown in solid in FIG. 10) which is generally coplanar with central section 120, and a second position (shown in phantom) wherein the side section 122 is angled from the plane of the central section 120. Side section 122 is movable to accommodate children of different sizes. When the side section 122 is in its second position, angled from the plane of the central section 120, the side section 122 is positioned to resist lateral movement of an occupant 126 of the chair. This resistance to lateral movement is especially useful when the occupant 126 is an infant who has either not developed or coordinated sufficiently to sit up straight in seat 20. Second side section 124 is similarly movable. When both side sections 122, 124 are in their second positions, the sections 122, 124 are positioned to resist lateral movement in the directions indicated by arrows R and S in FIG. 10. The central section 120, first side section 122, and second side section 124 are part of the cushion portion 27 of back support portion 22.

The cushion portion 27 includes a padded portion 128 to provide a cushioned seat for occupant 126, a relatively rigid backing portion 130, and a fabric cover 132, which is preferably made of vinyl or other material which can be cleaned easily. The padded portion 128 is preferably constructed of three separate pieces of contoured, tufted foam material, thus providing a first crease 136 and a second creas 138 which facilitates the movement of side sections 122,124 about their respective axes.

The backing portion 130 includes a stationary, central section rigid backing member 142, a first side section backing member 144, and a second side section backing member 146 which correspond in position generally to the stationary central section 120, first side section 122, and second side section 124, respectively, of cushion 27. The backing members 142,144,146 are preferably constructed of a material such as chip board, MASONITE, or the like, and comprise three separate pieces.

Figure 7:
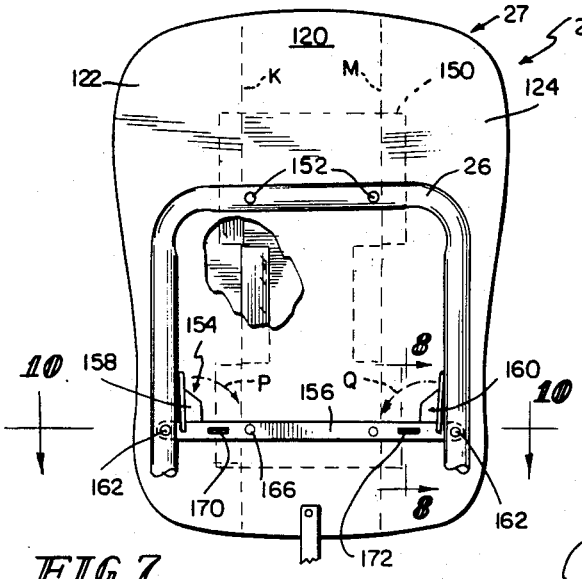
FIG. 7 is a rear elevational view of the back support portion of the seat.
Figure 8:
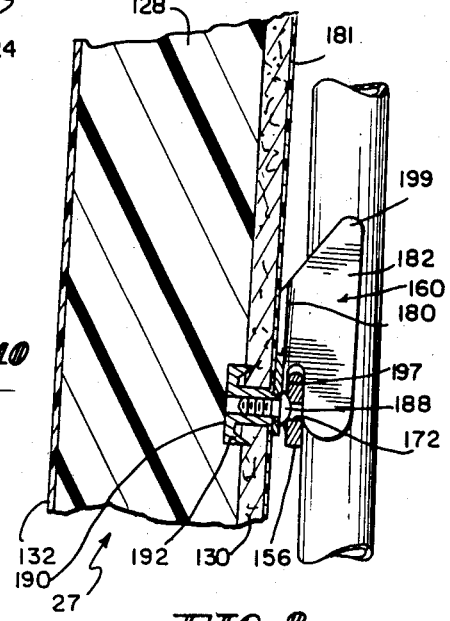
FIG. 8 is a sectional view taken along lines 8—8 of FIG. 7.
Figure 9:
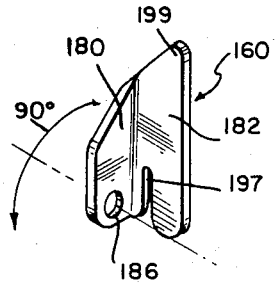
FIG. 9 is a perspective view of the latch member of the retention means of the instant invention; and, FIG. 10 is a sectional view taken along lines 10—10 of FIG. 7.
Figure 10:
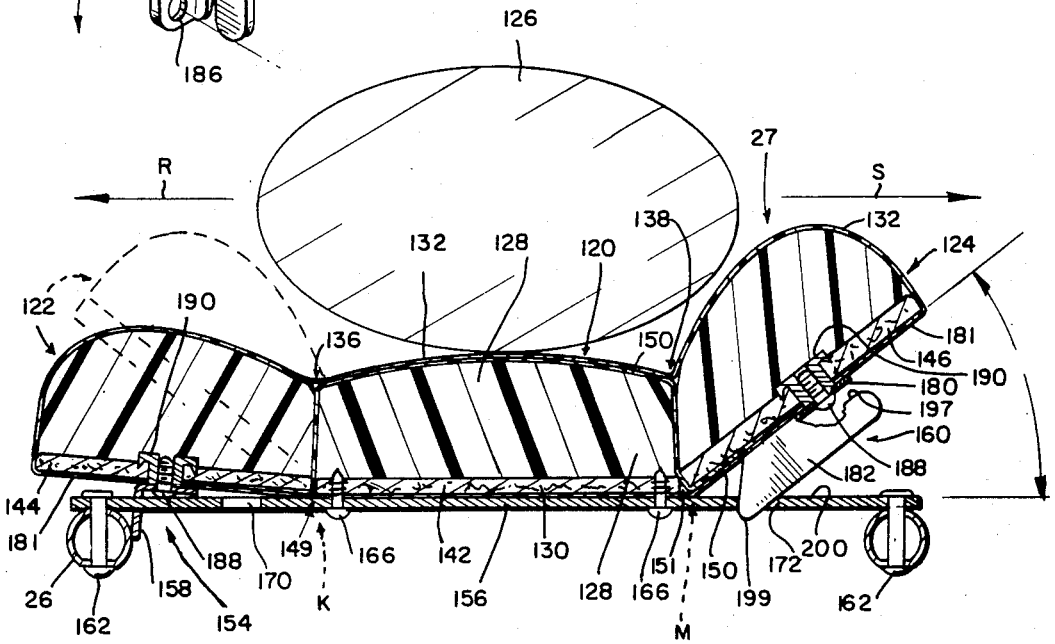

A fabric or plastic hinge panel 150 is interleaved between the sections of the padded portion 128 as shown in FIGS. 7 and 10. The hinge panel 150 extends across the front of the central section of the padded portion 128 and between the side sections and the central section. The panel is cut to produce end flaps which are glued or otherwise attached to the backing members 142,144,146. The hinge panel 150 thus serves to hingedly mount the first side section backing member 144 and second side section backing member 146, to the central section backing member 142. The placement of hinge panel 150 and backing members 142,144,146 allows the first side section backing member 144 and second side section backing member 146 to hingedly move about generally vertical hinge axes K,M, respectively, as best seen in FIG. 7. Hinge axis K is defined generally by the space 149, between the first side section backing member 144 and central section backing member 142. Hinge axis M is defined generally by the space 151, between second side section backing member 146 and central section backing member 142. The central section backing member 142 is fixedly attached to back support portion frame member 26 by screws 152 which are threadably received by the backing member 142.

A retention means 154 is provided for retaining the side sections 122,124 in their first and second positions. Retention means 154 includes an elongated bar 156, a first side section latch member 158, and a second side section latch member 160. Elongated bar 156 is fixedly attached to the base support frame member 26 by rivets 162, and is fixedly attached to the central section backing member 142 by screws 166 which are threadably received by central section backing member 142. Bar 156 includes a first aperture 170 for receiving the first side section latch member 158 when the first side section 122 is in its second position, and a second aperture 172 for receiving the second side section latch member 160 when second side section 124 is in its second position.

The first and second side section latch members 158,160 are mirror images of eacn other. Each of the latch members 158,160 includes a first leg portion 180 which is disposed generally parallel to the backing surface 181 of side sections 122,124 and a second leg portion 182 which is disposed generally perpendicular to the backing surfaces 181 of side section 122,124. The first leg 180 includes an aperture 186 through which a screw 188 can pass. Screw 188 is received by an anchor 190 having gripping prongs 192 to grip hinge panel 150 and one of the side section backing members 144,146. The screws 188, apertures 186, and anchors 190 are cooperable to movably mount the latch member 158 to first side section 122 and latch member 160 to second side section 124.

Each of the second leg portions 182 of latch members 158,160 includes a slot 197 which is positioned to engage elongated bar 156 when the side sections 122,124 are in their first position, generally coplanar with central section 120. The engagement of the slot 197 of first latch member 158 with bar 156 is shown in FIGS. 7 and 10. Each second leg portion 182 also includes a corner portion 199 which is positioned to be received by slots 170,172 in elongated bar 156. The corner portions 199 engage the slots 170,172 when the side sections 122,124 are in their second positions. The engagement of corner portion 199 of latch 160 by aperture 172 is shown in FIG. 10.

To operate the retention means 154 to move the side sections 122,124 from their first positions to their second positions, the latch members 158,160 are rotated 90° about the axis defined by screw 188 from a position wherein the second legs 188 are generally perpendicular to the ground, to a position wherein the second legs 182 are generally parallel with the ground. First latch member 158 is rotated in a clockwise direction, as indicated by arrow P in FIG. 7, and second latch member 160 is rotated in a counterclockwise direction, as indicated by arrow Q in FIG. 7. When the latch members 158,160 are so rotated, the slots 197 become disengaged from bar 156, permitting the side sections 122,124 to be moved forwardly. The side sections 122,124 are moved forwardly to a point wherein the corner portions 199 of latch members 158,160 have cleared the forward side 200 of bar 156. The latch members 158,160 are then rotated further in their same respective directions until the corner portions 199 are positioned to be received by slots 170,172. The side sections 122,124 are then released backwardly until the corner portions 199 of latch members 158,160 are received by their respective slots 170,172. To move the side sections 122,124 from their second positions to their first positions, the above described procedure is generally reversed.

What is claimed is:

1. A small child's chair comprising a seat having a base portion and a back support portion, said back support portion including a generally rigid frame member and a cushion portion including a stationary central section and at least a first side section movable with respect to the stationary central section to position the child on the seat, and retention means for retaining the movable first side section in a selected position relative to the stationary central section, the retention means including an elongated bar member having an aperture, means for attaching the bar member to the frame member, and a latch member movably mounted to the side section, the latch member including a first leg, and a second leg at an angle with respect to the first leg, the second leg including a slot engageable with the bar member to define a first engaging portion for engaging the bar member when the first side section is in a first position and a corner portion engageable with said aperture in the bar member to define a second engaging portion for engaging the bar member when the first side section is in a second position.

2. A small child's chair comprising a seat having a base portion and a back support portion, said back support portion including a generally rigid frame member and a cushion portion including a stationary central section and at least a first side section movable with respect to the stationary central section to position the child, the cushion portion further including cushioning material, a generally rigid backing adjacent the frame member, the backing including a central member corresponding in position to the central section of the cushion and a side member corresponding in position to the side section of the cushion, and backing hinge means for hingedly coupling the side member and central member of the backing, and retention means for retaining the movable first side section in a selected position relative to the stationary central section, the retention means including an elongated bar member, means for fixedly attaching the bar member to the frame member, the bar member having an aperture, and a latch member movably mounted to the side member, the latch member including a first leg and a second leg at an angle with respect to the first leg, the second leg having a slot engageable with the bar member for retaining the side section in a first position generally coplanar with the central section and a corner portion engageable with the aperture in the bar member for retaining the side section in a second position angled from the plane of the central section.

3. The invention of claim 1, further comprising a first hinge means for hingedly mounting the first side section to a first side of the central section, a second side section movable with respect to the central section, a second hinge means for hingedly mounting the second side section to a second side of the central section, and retention means for retaining the second side section in a selected position relative to the central section, the first and second side sections being movable with respect to the central section between a first position generally coplanar with the central section and a second position angled from the plane of the central section to restrict lateral movement of the child.

4. The invention of claim 1, further comprising a second side section movable with respect to the central section between a first position and a second position, and retention means for retaining the second side section in the first and second positions, the first and second side sections, when in their first positions, being generally coplanar wth the central section, and, when in their second positions, being angled from the plane of the central section to restrict lateral movement of the child.

* * * * *